US011333467B2

(12) United States Patent
Widder et al.

(10) Patent No.: US 11,333,467 B2
(45) Date of Patent: May 17, 2022

(54) VARIABLE VELOCITY VARIABLE TRAJECTORY PISTON PROPULSION AMMUNITION CASE

(71) Applicant: Vincent Battaglia, Monroe, CT (US)

(72) Inventors: Jeff Widder, Bel Air, MD (US); Vincent Battaglia, Easton, CT (US); Philip Battaglia, Monroe, CT (US)

(73) Assignee: Vincent P. Battaglia, Monroe, CT (US)

( * ) Notice: Subject to any disclaimer, the term of this patent is extended or adjusted under 35 U.S.C. 154(b) by 220 days.

(21) Appl. No.: 16/838,170

(22) Filed: Apr. 2, 2020

(65) Prior Publication Data

US 2020/0378732 A1 Dec. 3, 2020

Related U.S. Application Data

(60) Provisional application No. 62/854,069, filed on May 29, 2019.

(51) Int. Cl.

| | |
|---|---|
| ***F42B 5/02*** | (2006.01) |
| ***F42B 30/04*** | (2006.01) |
| *F42B 8/18* | (2006.01) |

(52) U.S. Cl.

CPC ..... *F42B 5/02* (2013.01); *F42B 30/04* (2013.01); *F42B 8/18* (2013.01)

(58) Field of Classification Search

CPC .... F42B 5/00; F42B 5/02; F42B 5/025; F42B 5/045; F42B 8/18; F42B 30/04

USPC ..... 102/470, 482, 483, 487

See application file for complete search history.

(56) References Cited

U.S. PATENT DOCUMENTS

| | | | | |
|---|---|---|---|---|
| 3,726,218 A * | 4/1973 | Austin, Jr. | ..... | F42B 5/025 102/439 |
| 5,880,397 A * | 3/1999 | Crilly | ..... | F42B 15/10 |
| 9,200,876 B1 * | 12/2015 | Thomas | ..... | F42C 19/0823 |
| 9,534,858 B2 * | 1/2017 | Forbes | ..... | F41C 27/06 |

* cited by examiner

*Primary Examiner* — James S Bergin

(74) *Attorney, Agent, or Firm* — DeLio Peterson & Curcio LLC; Peter W. Peterson

(57) ABSTRACT

A medium caliber round of ammunition capable of being fired at variable velocities and trajectories, and methods of firing such, are presented herein. The ammunition round includes a grenade and a cartridge received in a firing chamber. The cartridge has a front case for receiving the grenade, and a rear case for receiving a primer. An adjustable variator collar is disposed between the front and rear cases. The variator collar is adjustable between a first position that chokes the venting of gas from a high-side stage to a low-side stage for low muzzle velocity, and a second position for un-choking the venting of gas from the high-side stage to the low-side stage for a rapid rise in pressure during the low-side stage, resulting in a high muzzle velocity. The collar may further be adjusted in any position between the first and second for relative amounts of controlled fluid flow.

2 Claims, 5 Drawing Sheets

VARIABLE VELOCITY VARIABLE TRAJECTORY PISTON PROPULSION AMMUNITION CASE

BACKGROUND OF THE INVENTION

1. Field of the Invention

This invention relates to ballistics, and more specifically to the cartridge structure for firing medium caliber projectiles such as grenades.

2. Description of Related Art

Conventional low velocity shells (such as 40 mm grenades) and their respective cartridge structures are constructed in such a way that limits the projectile to a single velocity and trajectory path upon firing. These designs greatly limit the ability for riflemen to effectively hit their target, especially when the target is placed too close, or at high or low angles with respect to the rifleman. Such a target would require firing the shell at an angle greater than 40 degrees, rendering weapon sight use obsolete and resulting in the rifleman "estimating" the necessary launch path. Target spaces located outside of the rifleman's line of sight is commonly known as dead space, where direct-fire weapons cannot be effectively used.

SUMMARY OF THE INVENTION

Bearing in mind the problems and deficiencies of the prior art, it is therefore an object of the present invention to provide a medium caliber ammunition case capable of being fired at lower than standard velocities and at a lower launch angle to allow use of the weapon's sight attachments and still achieve a high angle of attack to hit targets in dead space.

A further object of the invention is to provide a medium caliber ammunition case capable of being fired at higher than standard velocities with a lower angle of attack to make range estimation less critical.

It is yet another object of the present invention to provide a medium caliber ammunition case that is adjustable to control muzzle velocity and recoil impulse.

Still other objects and advantages of the invention will in part be obvious and will in part be apparent from the specification.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-12 of the drawings in which like numerals refer to like features of the invention.

Figure 2:
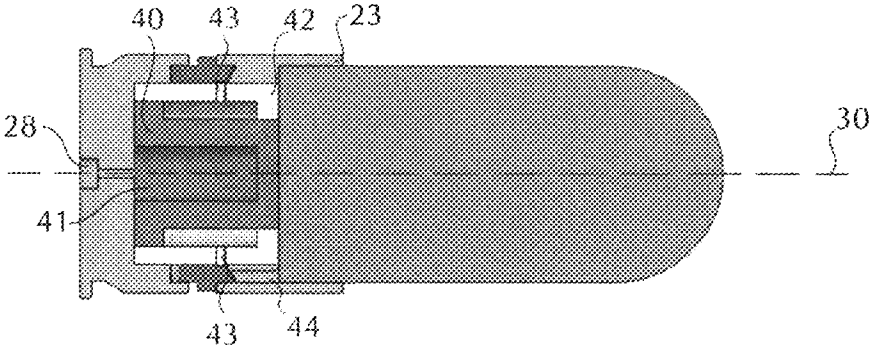
FIG. 2 is a side cross-sectional view of the ammunition case of FIG. 1.
Figure 1:
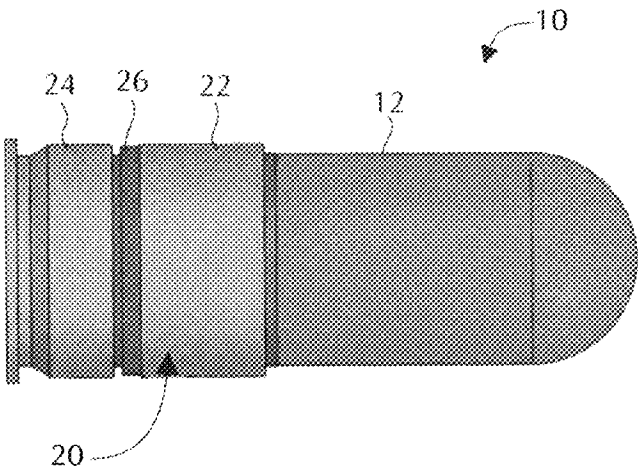
FIG. 1 is a side view of the ammunition case of the present invention.

The ammunition case of the present invention as shown in FIG. 1 (and in the alternate embodiments presented in FIGS. 9-12) presents a medium caliber ammunition round 10 having a grenade 12 and a cartridge 20, all which may be disposed within a firing chamber 14 as shown in later FIGS. 5-8. Cartridge 20 comprises a front cartridge case 22 and rear cartridge case 24, with an adjustable velocity variator collar 26 disposed concentrically between the cartridge cases 22, 24. Front cartridge case 22 has a forwardly extending flange 23 which creates an opening or chamber 45 for the rear of grenade 12 to sit within. A primer 28 is disposed within the rear cartridge case 24. The grenade 12, front cartridge case 22, rear cartridge case 24, variator collar 26, and primer 28 all share the same axial center, represented in FIG. 2 as axis 30.

Disposed within cartridge 20 is a hollow piston 40 encased by a cylinder 42 having vents 43 placed about its periphery and extending radially outward through the cylinder walls. Grenade 12 is positioned within the chamber 45 such that the rear of the grenade 12 sits flush with the front of the piston 40 and cylinder 42. The piston 40 is moveable within the body of the cylinder 42 between a first, stationary position where the rear of the piston sits up against the rear inner wall of the rear case 24, and a second, extended/thrusted position where the piston 40 is extended forward beyond the cylinder 42 forward end and vents 43 into the chamber 45, such that the vents 43 are exposed within the cylinder 42. Piston 40 may further have at least one relief vent extending through its walls (not shown) to act as a secondary form of ventilation should the piston fail to complete its stroke and reach the second position, since the cylinder vents 43 may still be blocked by the piston body under this condition. A combustible compound 50 is disposed within a cavity 41 of the hollow piston to push the piston through the cylinder via a gas 52 generated upon ignition of the combustible compound via the primer 28.

Figure 9:
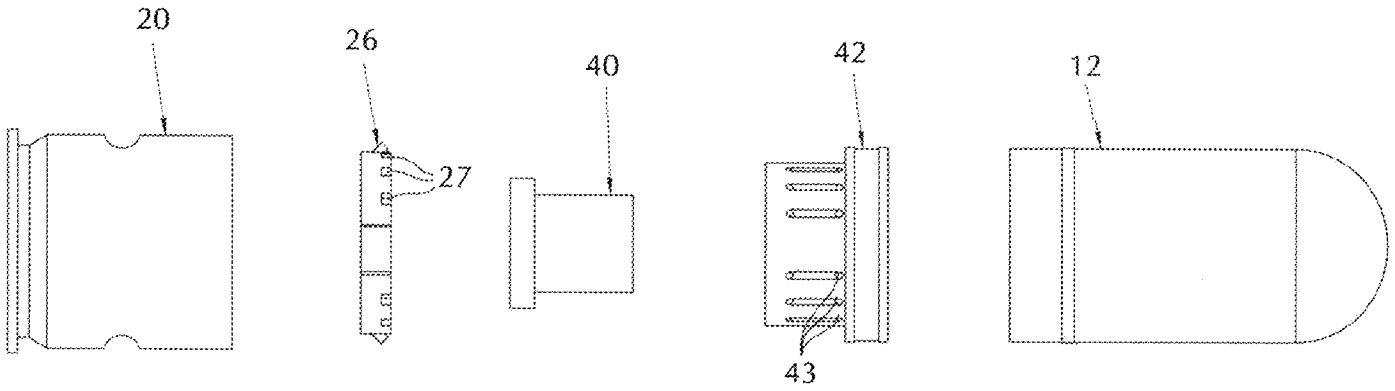
FIG. 9 is a side exploded view of an embodiment of the ammunition case of the present invention, where the cartridge has a concave gap meant for an end user to access the variator collar for adjustments.
Figure 11:
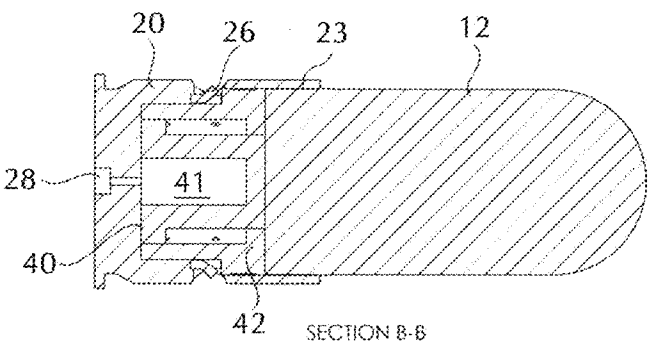
FIG. 11 is a side cross-sectional view of the ammunition case of FIG. 10 along lines B-B.
Figure 10:
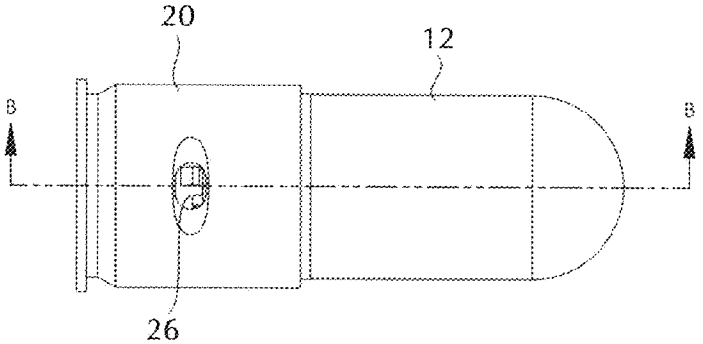
FIG. 10 is a side planar view of the embodiment of the ammunition case of FIG. 9.
Figure 12:
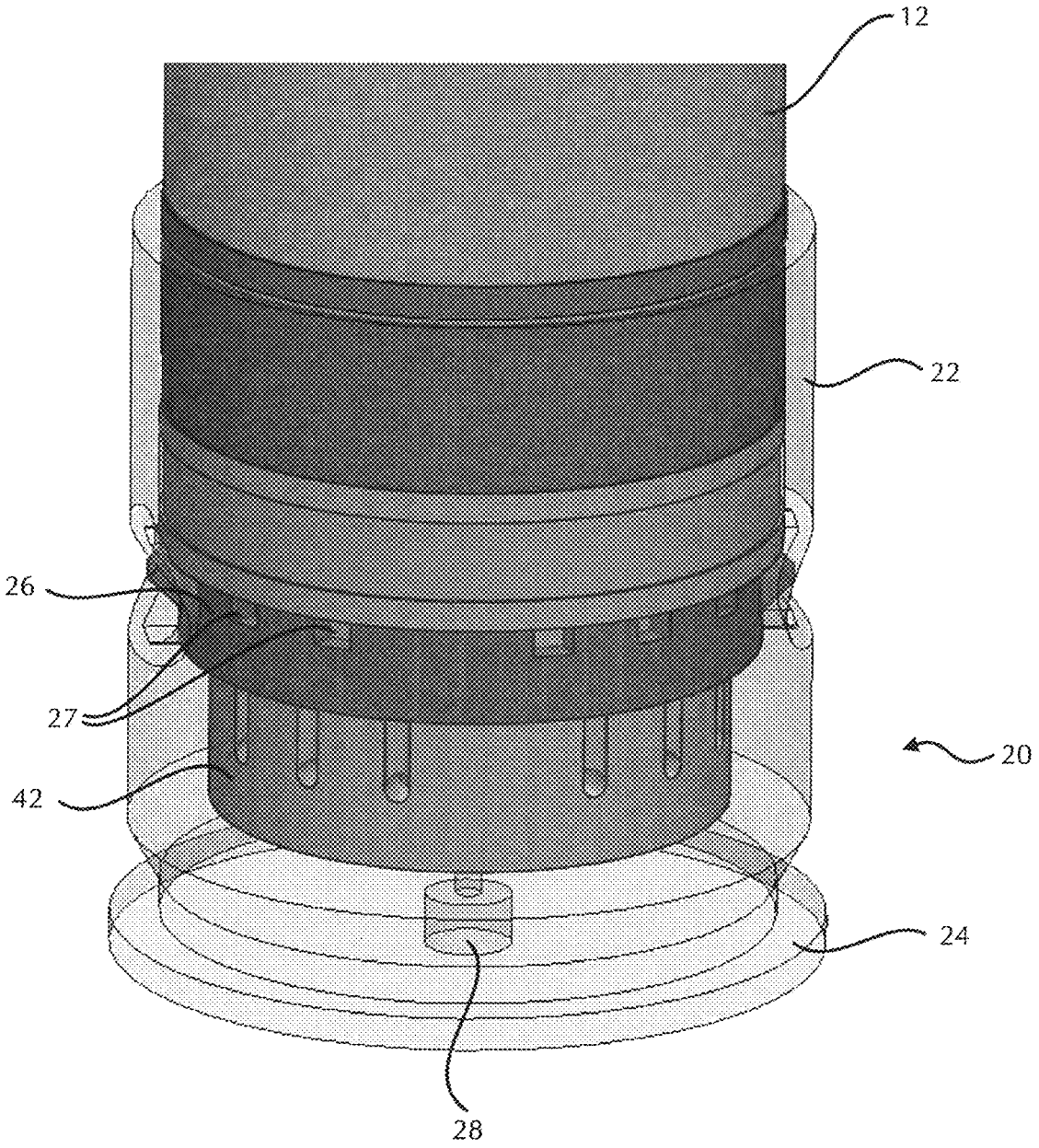
FIG. 12 is a partial cross-sectional perspective view of the embodiment of the ammunition case of FIG. 9.

In operation, the ammunition case of the present invention transitions from a high-side stage to a low-side stage upon ignition. In the high-side stage, combustion gasses fill the cavity 41 within the piston 40 and thrust the piston forward from the first position to the second position along the longitudinal axis 30. In this high-side stage, the forces created by the high pressure gas within the piston remain constant regardless of variator collar position (the effects of collar positioning which will be explained in further detail below). As the piston moves from the first position to the second position, the low-side stage begins. In the low-side stage, gasses built up within the piston cavity 41 and cylinder 42 travel through the now exposed vents 43 and channels 44 into the chamber 45 behind the grenade 12, and the forces generated by the expanding gasses 52 within this chamber push the grenade 12 through the firing chamber 14. This stage is designated as the low-side stage due to the drop in pressure when compared to the pressure levels created in the high-side stage; the volume occupied in the high-side stage is smaller than that in the low-side stage, hence the pressure differential. The position of the velocity variator collar 26 adjusts the forces exerted behind the grenade during the low-side stage, as further explained below. Variator collar 26 may have collar vents 27 disposed about its periphery as shown in FIGS. 9 and 12. These collar vents 27 may line up at least partially with the vents 43 of the cylinder 42 to provide different levels of gas ventilation into the low-side stage, which is determinative of the collar 26 position.

Figure 3:
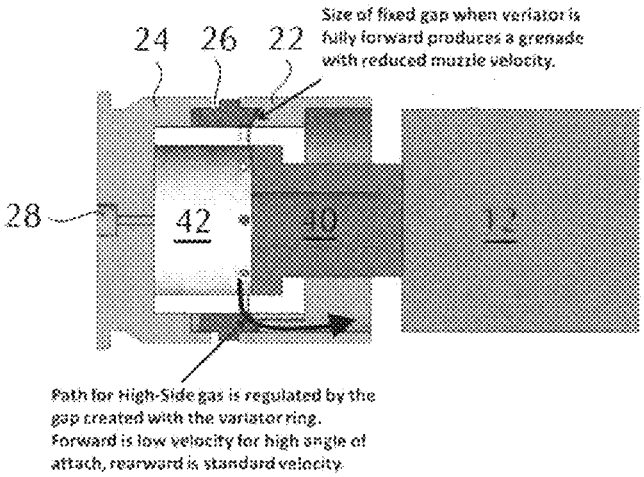
FIG. 3 is a side cross-sectional view of the ammunition case and variator collar in the first position covering at least a portion of a cylinder's vents, with arrows depicting the lower-to-no volume of fluid flow into the chamber behind a grenade in a low-side stage resulting in a low muzzle velocity.
Figure 4:
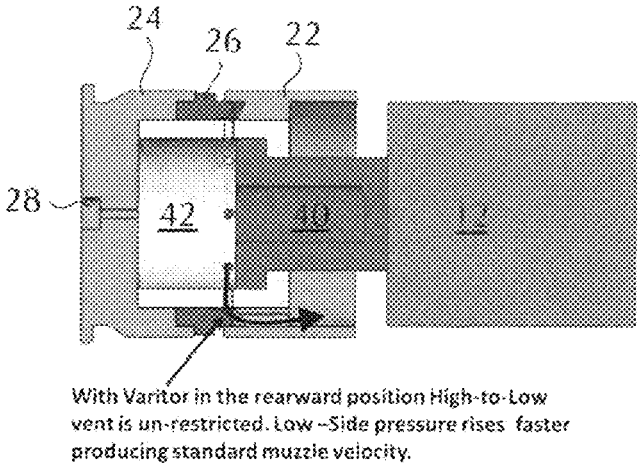
FIG. 4 is a side cross-sectional view of the ammunition case and variator collar in the second position leaving a cylinder's vents fully open, with arrows depicting the higher volume of fluid flow into the chamber behind the grenade in the low-side stage resulting in a high muzzle velocity.
Figure 6:
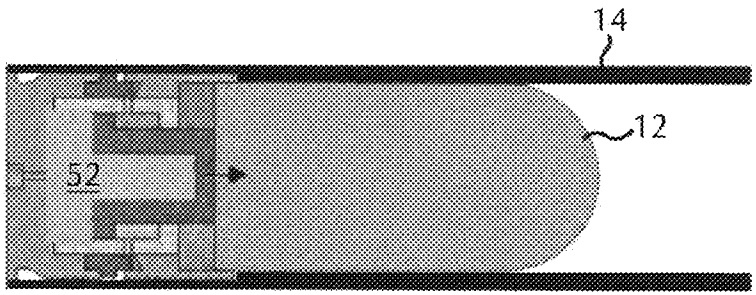
FIG. 6 is a side cross-sectional view of the ammunition case and firing chamber of FIG. 5, showing initiation of a high-side stage where the hollow piston is in motion heading towards a second, thrusting position as a result of expanding combustion gasses released within the piston, and the combustion gasses subsequently expanding within the body of the cylinder.

The velocity variator collar 26 is adjustable between a first position that chokes the venting of gas from the high-side stage to the low-side stage for low muzzle velocity, and a second position for un-choking the venting of gas from the high-side stage to the low-side stage for a rapid rise in low-side stage pressure, resulting in a high muzzle velocity, as shown across FIGS. 3-4, respectively. The collar 26 may further be placed in any position between the first and second position for relative amounts of controlled fluid flow, dependent on shooter preference and needs. While placing the collar 26 in the first position results in an effective partial blocking of the vents 43 as further described below, a minimum fixed opening is still established between the variator collar 26 and vents 43 to allow for some degree of ventilation from within the piston 40 and cylinder 42 after combustion has occurred therein and the piston has reached its second position (past the vents 43). These minimum fixed openings are necessary to prevent any internal structural damage or misfiring that would otherwise occur from improper ventilation of the expanding gasses within the cartridge 20.

In the first position, the variator collar 26 is disposed closer to the front cartridge case 22, and may effectively cover the vents 43 of the cylinder 42 as shown in FIG. 3. If in the first position the variator collar 26 is placed in the front-most position, the gas produced by the ignition of the combustible compound will escape slowly from within the walls of the piston 40 and cylinder 42 upon firing, resulting in a minimum low-side stage pressure and, subsequently, a lower muzzle velocity release of the grenade 12 from the cartridge 20. By effectively lowering the grenade velocity using the variator collar's first position, the shooter may decrease the launch angle and use the weapon's sight attachment to increase their probability of hitting the target at short range with their first round of ammunition used. This results in a higher effectiveness of use, and a lower depletion of ammunition over time, thus saving costs, increasing shooter efficiency, and/or increasing the number of targets effectively engaged.

Figure 8:
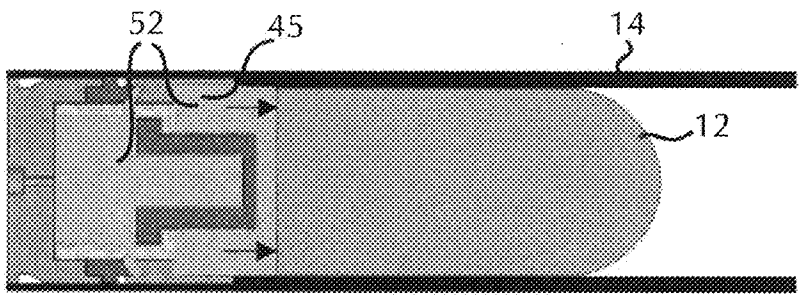
FIG. 8 is a side cross-sectional view of the ammunition case and firing chamber of FIG. 5, showing the hollow piston in its completed second position and the expanding combustion gasses filling the chamber behind the grenade in the low-side stage to provide further propulsion forces resulting in high muzzle velocity.
Figure 5:
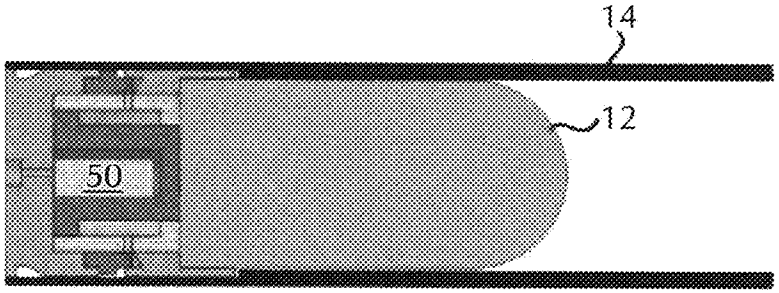
FIG. 5 is a side cross-sectional view of the ammunition case of FIG. 4 disposed within a firing chamber, the variator collar in the second position for un-hindered gas flow and high muzzle velocity in the low-side stage, and a hollow piston in its first, non-moving position.
Figure 7:
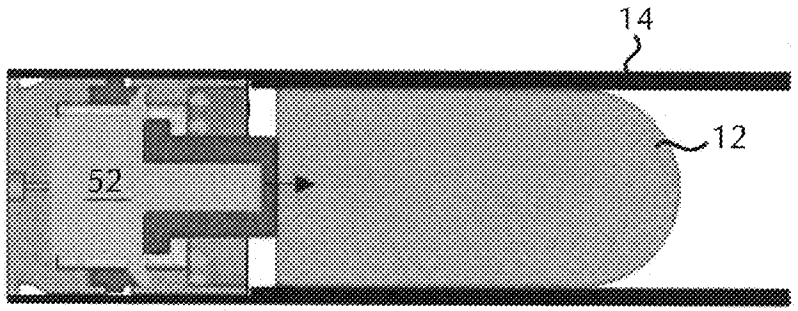
FIG. 7 is a side-cross sectional view of the ammunition case of FIG. 5 disposed within a firing chamber, the variator collar in a second position where the cylinder vents are fully exposed for full gas flow and high muzzle velocity, and the hollow piston in motion in the high-side stage as a result of expanding combustion gasses released within the piston, the gasses beginning to travel through the vents within the cylinder and further through channels leading into a chamber formed behind the grenade.

In the second position, the variator collar 26 is disposed closer to the rear cartridge case 24, exposing a larger portion or all of the vents 43 of the cylinder 42 as shown in FIG. 4. Upon firing, the gas produced by the ignition of the combustible compound passes uninhibited through the vents 43, resulting in a rapid rise in low-side stage pressure, demonstrated across FIGS. 5-6. After the piston pushes through the cylinder imparting the first, high-side stage of thrust to the grenade, the vented gas travels through the now exposed vents 43, around the variator collar and through channels 44, into the second chamber 45 located in front of the cylinder, in the space previously occupied by the grenade prior to initiating the firing sequence (as demonstrated in FIG. 7). This vented gas thus provides a secondary force behind the grenade directly after being struck by the piston, as the grenade continues to travel through the barrel of its firing chamber, as shown in FIG. 8. What results is a higher muzzle velocity release of the grenade 12 from the cartridge 20, which may now travel further distances and is intended for targets further away.

While the variator collar 26 is shown sliding in relief portions of cases 22 and 24, movement may be effected by any desired mechanism or structure such as threads around the periphery, gears, or the like.

Thus, the present invention provides one or more of the following advantages: 1) a medium caliber ammunition case capable of controlling the rate of venting combustion-induced gas; 2) a medium caliber ammunition case capable of being fired at lower than standard velocities and at a lower launch angle to allow use of the weapon's sight attachments and still achieve a high angle of attack to hit targets in dead space; 3) a medium caliber ammunition case capable of being fired at higher than standard velocities with a lower angle of attack to make range estimation less critical; 4) a medium caliber ammunition case with an adjustable collar to control muzzle velocity and recoil impulse.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of firing a medium caliber round of ammunition at variable velocities and trajectories, comprising:

providing a medium caliber ammunition round (10) disposed within a firing chamber (14) of a rifle, the ammunition round (10) comprising a grenade (12), and a cartridge (20), the cartridge having a longitudinal axis (30), a front case (22) having a forwardly extending flange (23) and channels (44) through walls of the front case parallel to the longitudinal axis (30), the grenade (12) being seated within the flange, and a rear case (24) with a primer opening (28), a cylinder (42) in axial alignment with the cartridge (20) having a chamber therein and vents (43) about peripheral interior walls of the cylinder, the vents (43) extending radially outward through the cylinder walls and being in fluid communication with the channels (44), a hollow piston (40) in axial alignment with the cartridge (20) and slideably disposed within the cylinder (42) chamber and having a cavity (41) facing the primer opening (28), the piston (40) having a combustible compound (50) disposed within the cavity (41) for creating a combustion gas (52) upon ignition, the piston (40) further being movable between a first position in which a rear of the piston is adjacent a rear inner wall of the rear case (24) and a front of the piston sits flush with a forward end of the cylinder (42) and is further in contact with a rearmost portion of the grenade (12), and a second position where the piston (40) is extended forward beyond the cylinder (42) forward end and the cylinder vents (43) into a second chamber (45), such that the vents (43) are exposed within the cylinder (42), a variator collar (26) disposed on the cartridge between the front case (22) and the rear case (24), the variator collar (26) being adjustable between a first position reducing fluid flow between the vents and channels and a second position increasing fluid flow between the vents and channels within the front case; adjusting the variator collar (26) to a position between the first position and the second position; striking a primer (28) within the rifle to ignite the combustion compound (50); igniting the combustible compound (50) within an opening of the piston (40) to create the combustion gas (52); propelling the piston (40) through the cylinder (42) chamber from the piston first position toward the piston second position to move the grenade (12) forward to form the second chamber (45) forward of the front case; continuing to move the piston (40) forward to the piston second position to expose the vents (43) in the cylinder (42); causing the gas (52) to flow from the vents (43) within the cylinder (42) through the channels (44) to the second chamber (45) formed forward of the front case via a gas flow volume, the rate of volume established by the position of the variator collar (26); imparting thrust to the grenade by the propelling piston and subsequent gas flow; and firing the grenade (12) out of the cartridge (20).

2. A medium caliber round of ammunition capable of being fired at variable velocities and trajectories, comprising: a medium caliber ammunition round (10) disposed within a firing chamber (14) of a rifle, the ammunition round (10) comprising a grenade (12), and a cartridge (20), the cartridge having a longitudinal axis (30), a front case (22) having a forwardly extending flange (23) and channels (44) through walls of the front case parallel to the longitudinal axis (30), the grenade (12) being seated within the flange, and a rear case (24) with a primer opening (28); a cylinder (42) in axial alignment with the cartridge (20) having a chamber therein and vents (43) about peripheral interior walls of the cylinder, the vents (43) extending radially outward through the cylinder walls and being in fluid communication within the channels; a hollow piston (40) in axial alignment with the cartridge (20) and slideably disposed within the cylinder (42) chamber and having an opening facing the primer opening (28), the piston (40) having a combustible compound (50) disposed within the opening of the piston for creating a combustion gas (52) upon ignition, the piston (40) further being movable between a first position in which a rear of the piston is adjacent a rear inner wall of the rear case (24) and a front of the piston sits flush with a forward end of the cylinder (42) and in contact with a rearmost portion of the grenade (12), and a second position where the piston (40) is extended forward beyond the cylinder (42) forward end and the cylinder vents (43) into a second chamber (45), such that the vents (43) are exposed within the cylinder (42); and a variator collar (26) disposed on the cartridge between the front case (22) and the rear case (24), the variator collar (26) being adjustable between a first position reducing fluid flow between the vents and channels and a second position increasing fluid flow between the vents and channels within the front case.

* * * * *